US008716934B2

(12) United States Patent
Fujitaka et al.

(10) Patent No.: US 8,716,934 B2
(45) Date of Patent: May 6, 2014

(54) SHORT ARC DISCHARGE LAMP

(71) Applicant: Ushio Denki Kabushiki Kaisha, Tokyo (JP)

(72) Inventors: Koji Fujitaka, Himeji (JP); Hirohisa Iwabayashi, Himeji (JP)

(73) Assignee: Ushio Denki Kabushiki Kaisha, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/896,724

(22) Filed: May 17, 2013

(65) Prior Publication Data

US 2013/0320845 A1 Dec. 5, 2013

(30) Foreign Application Priority Data

May 31, 2012 (JP) ..... 2012-124060

(51) Int. Cl.
*H01J 17/04* (2012.01)
*H01J 61/04* (2006.01)

(52) U.S. Cl.
USPC ..... 313/633; 313/632

(58) Field of Classification Search
CPC ... H01J 61/0735; H01J 61/0737; H01J 61/86; H01J 61/073; H01J 61/98
USPC ..... 313/623–625, 634–636, 493, 318.12, 313/570; 445/26–27
See application file for complete search history.

(56) References Cited

U.S. PATENT DOCUMENTS

2011/0181181 A1 7/2011 Shimizu et al. ..... 313/638
2012/0001541 A1 1/2012 Ikeuchi et al. ..... 313/632

FOREIGN PATENT DOCUMENTS

JP 2011-154927 A 8/2011
JP 2012-015007 A 1/2012

*Primary Examiner* — Donald Raleigh
(74) *Attorney, Agent, or Firm* — Fitzpatrick, Cella, Harper & Scinto

(57) ABSTRACT

Disclosed herein is a short arc discharge lamp which has a cathode electrode structure formed by solid-phase bonding a tip part made of thoriated tungsten to a body part made of tungsten. In the present invention, thorium can be reliably diffused onto the surface of the cathode electrode over a long period of time without stagnation of reduction of thorium oxide in the tip part. Therefore, satisfactory emission characteristics can be provided, whereby the arc stability is more reliable. The cathode electrode of the present invention is characterized in that potassium concentration of the body part is higher than potassium concentration of the tip part.

1 Claim, 5 Drawing Sheets

SHORT ARC DISCHARGE LAMP

CROSS REFERENCE TO RELATED APPLICATION

This application claims the benefit of Japanese Patent Application No. 2012-124060, filed on May 31, 2012, which is hereby incorporated by reference in its entirety into this application.

BACKGROUND OF THE INVENTION

1. Technical Field

The present invention relates generally to short arc discharge lamps and, more particularly, to a short arc discharge lamp in which a cathode electrode is provided with a tip part containing thorium oxide.

2. Description of the Related Art

Generally, short arc discharge lamps filled with xenon, which are used as light sources for projectors, or short arc discharge lamps filled with mercury, which are used as light sources of semiconductor or LCD exposure apparatuses, DC discharge lamps.

FIG. 3 illustrates a representative example of such short arc discharge lamps. A discharge lamp 1 includes an arc tube 2 which has a light emitting part 3 and sealing parts 4 formed on opposite ends of the light emitting part 3. A cathode electrode 5 and an anode electrode 6 are disposed opposite to each other in the light emitting part 3. The discharge lamp 1 is turned on by a DC lighting system.

In this way, the discharge lamp is turned on, and the spot of arc is fixed at the front end of the cathode electrode so that it can be used as a point light source. Therefore, when the discharge lamp is combined with an optical system, high light utilization efficiency can be realized.

Cathode electrodes which are typically used in such DC discharge lamps constantly function to emit electrons when the discharge lamps are turned on stationarily. Therefore, cathode electrodes made of high melting point metal mixed with an emitter material are mainly used so as to facilitate emission of electrons.

In such a discharge lamp which requires a point light source and high luminance, thorium oxide which can increase the operating temperature of the front end of the cathode electrode is generally used as the emitter material. However, because thorium oxide is a radioactive material, there are many regulations these days with regard to handling it. Hence, if there is no choice but to use thorium oxide for the cathode electrode, it is required to reduce thorium oxide content to the minimum.

In this respect, as a method of manufacturing a cathode electrode that contains thorium oxide as emitter material, a technique in which a body part of the cathode electrode is made of tungsten and a tip part made of thoriated tungsten containing thorium oxide is solid-phase bonded to a front end of the body part was introduced in Japanese Patent Laid-open Publication No. 2011-154927 (Patent document 1).

The structure of the cathode electrode according to this technique will be explained with reference to FIG. 4. The cathode electrode 5 includes a body part 51 which is disposed at a rear position, and a tip part 52 which is bonded to a front end of the body part 51. The body part 51 is made of pure tungsten, while the tip part 52 is made of thoriated tungsten which contains thorium oxide ($ThO_2$) as an emitter material. In detail, thorium oxide content ranges from 0.5% to 3 wt %, for example, 2 wt %.

Overall, the cathode electrode 5 has a cylindrical shape, and its front end that includes the tip part 52 is tapered.

While the lamp is being turned on, the thorium oxide that is contained in the tip part 52 of the cathode electrode 5 is heated and thus reduced so that thorium atoms are obtained. Thorium atoms which are formed by the reduction process in the cathode electrode 5 are moved to the surface of the cathode electrode 5 mainly by grain boundary diffusion among tungsten crystal grains and are exposed to the outside. Thereafter, the exposed thorium atoms move to the front end of the cathode electrode and cover the front end of the cathode electrode. The covering layer of thorium atoms, lowering the work function of the cathode, promotes emission of electrons, thus improving electron emission characteristics.

However, thorium oxide, which contributes to improvement in electron emission characteristics, is limited to existing only at a very shallow depth from the surface of the front end of the cathode electrode.

The reason for this is as follows: Although thorium is required to be continuously supplied to the front end of the cathode electrode because thorium is evaporated and consumed from the surface of the front end of the cathode electrode, if the lamp is in the turned on state over a long time, the reduction of the thorium oxide slows down and eventually stops, whereby the supply of reduced thorium is not performed enough. Therefore, even when the cathode electrode contains a sufficient amount of thorium oxide therein, the surface of the cathode electrode may enter a thorium-exhausted state.

Such stagnation of reduction pertains to the following idea.

When reduction of thorium oxide occurs due to C (Carbon) which is present in the arc tube (through the carburization of the cathode electrode, etc.), CO (carbon monoxide) gas is generated. The reduction occurs on the surface of the tip part of the cathode electrode or in the interior of the tip part. If CO is generated and accumulated in the cathode electrode and the pressure in the cathode electrode is increased, it becomes difficult to induce the reduction of thorium oxide. As a result, it may be impossible to supply thorium atoms to the surface of the cathode electrode.

FIGS. 5A and 5B schematically show the sectional structure of the front end of the cathode electrode. FIGS. 5A and 5B respectively illustrate an initial lighting state and a thorium-exhausted state after a predetermined time has passed.

As shown in FIG. 5A, in the initial lighting stage, both the tip part 52 and the body part 51 are in a small crystal grain state.

After a predetermined lighting time has passed, as shown in FIG. 5B, although thorium oxide is in the tip part 52, tungsten crystal grains of the tip part 52 gradually coarsen compared to those in the initial lighting stage, because the tip part 52 is exposed to high-temperature heat by arc. Meanwhile, because the body part 51, which is lower in temperature than the tip part 52, has not been processed by doping, a recrystallization temperature of tungsten is lower than that of thoriated tungsten of the tip part 52, and tungsten crystal grains of the body part 51 also coarsen as time passes.

As such, with the passage of time, tungsten crystal grains of both the body part 51 and the tip part 52 coarsen.

In this state, grain boundaries among crystal grains decrease. The grain boundary decrease reduces the area of a portion which can occlude CO which is generated by reduction of thorium oxide in the tip part 52. Eventually, CO concentration increases, and reduction of thorium oxide is no longer conducted, whereby the supply of thorium is interrupted. Furthermore, even if the CO concentration in the body part 51 is comparatively low, crystal grains coarsen and decrease the area of the portion which can occlude CO. Thus, it becomes difficult for the body part 51 to occlude CO gas. As a result, CO gas is accumulated in the cathode electrode.

Thereby, CO pressure in the tip part 52 is increased, and reduction of thorium oxide in the tip part 52 is stagnated. Consequently, the surface of the cathode electrode enters a thorium-exhausted state.

PRIOR ART DOCUMENT

Patent Document

Japanese Patent Laid-open Publication No. 2011-154927

SUMMARY OF THE INVENTION

Accordingly, the present invention has been made keeping in mind the above problems occurring in the prior art, and an object of the present invention is to provide a short arc discharge lamp which has a cathode electrode structure formed by solid-phase bonding a tip part made of thoriated tungsten to a body part made of tungsten, wherein thorium can be reliably diffused from the internal portion of the cathode electrode onto the surface thereof without stagnation of reduction of thorium oxide in the tip part made of thoriated tungsten, and the surface of the cathode electrode can be prevented from entering a thorium-exhausted state, whereby satisfactory electron emission characteristics can be reliably maintained for a long period of time.

In order to accomplish the above object, the present invention provides a short arc discharge lamp, including: an arc tube; and a cathode electrode and an anode electrode disposed opposite to each other in the arc tube, the cathode electrode comprising a body part made of tungsten and a tip part made of thoriated tungsten, the body part and the tip part being solid-phase bonded to each other, wherein the cathode electrode is configured such that potassium concentration of the body part is higher than potassium concentration of the tip part.

The present invention provides a cathode electrode structure formed by solid-phase bonding a tip part made of thoriated tungsten to a body part made of tungsten. A tip part of the cathode electrode is exposed to arc and heated to a high temperature. Thus, tungsten crystal grains grow and coarsen as the lighting time passes. Due to the coarsening of crystal grains, thorium oxide grains are collected close to the front end of the cathode electrode, as tungsten grain boundaries reduce. This locally provides the same effect as an increase in the thorium concentration. Thus, reduced thorium can be easily supplied to the front end of the cathode electrode.

Meanwhile, because the concentration of potassium in the body part of the cathode electrode is higher than that of the tip part, the recrystallization temperature increases, thus restraining the growth and coarsening of tungsten crystal grains. The restraining of the coarsening of tungsten crystal grains makes it possible for grain boundaries between the crystal grains to be maintained in the multiple and multi-branched state. These grain boundaries function as places to occlude CO gas generated by reduction of thorium oxide in the tip part of the cathode electrode. Therefore, CO gas generated from the tip part is occluded by the body part so that the reduction of the thorium oxide in the internal portion of the tip part can be prevented from being stagnated, and thorium can be reliably diffused and supplied onto the surface of the front end of the tip part over a long period of time. Thereby, the lifetime of the discharge lamp can be increased.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1A:
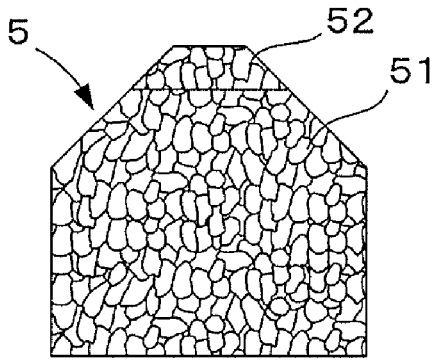
FIG. 1A is sectional view showing the structure of a cathode electrode of a short arc discharge lamp at initial lighting stage, according to the present invention.

Reference now should be made to the drawings, throughout which the same reference numerals are used to designate the same or similar components.

As shown in FIG. 1A, a cathode electrode 5 includes a body part 51 which is made of tungsten, and a tip part 52 which is made of thoriated tungsten and is solid-phase bonded to the body part 51. The body part 51 is made of, for example, tungsten (pure tungsten) having purity of 99.99%, and the tip part 52 is made of tungsten (thoriated tungsten) containing, for example, thorium oxide ($ThO_2$) of 2 wt %.

The body part 51 contains a larger amount of potassium than does the tip part 52. That is, the potassium concentration of the body part 51 is higher than that of the tip part 52.

To produce the cathode electrode 5, a tungsten (potassium-doped tungsten) rod which is processed by doping potassium is provided for the body part 51. Meanwhile, a thoriated tungsten rod which is processed substantially by doping only thorium oxide rather than potassium is provided for the tip part 52.

Thereafter, the tungsten rods which are provided for the body part 51 and the tip part 52 are put into surface contact with each other under pressure and maintained at a high temperature for a predetermined time. Then, atomic-level diffusion occurs on the junction interface so that the tungsten rods are strongly bonded to each other, thus forming the cathode electrode 5 in which the body part 51 and the tip part 52 are integrated with each other.

Thorium oxide and potassium which are added to tungsten are known to function to restrain growth of crystal grains of tungsten.

Figure 1B:
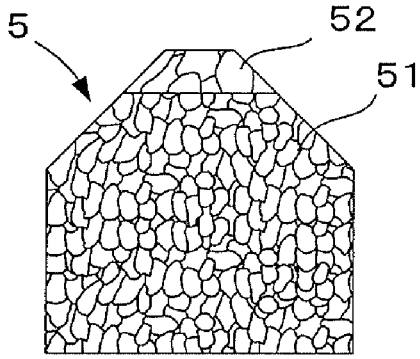
FIG. 1B is sectional view showing the structure of a cathode electrode of a short arc discharge lamp after predetermined lighting time, according to the present invention.
Figure 2:
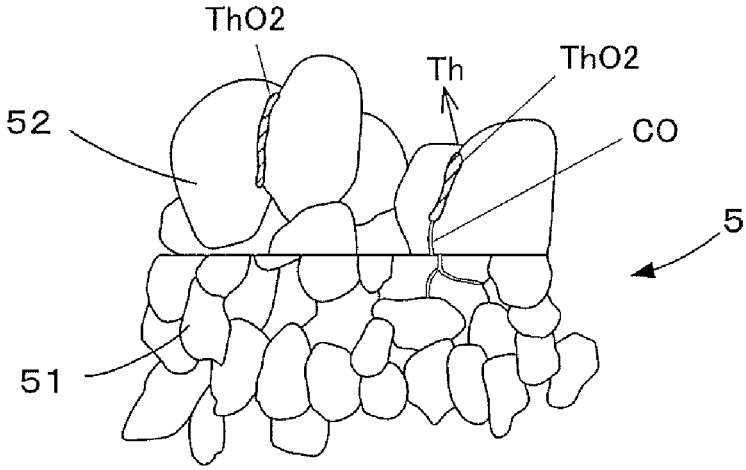
FIG. 2 is a partial enlarged view of the cathode electrode of FIGS. 1A and 1B.
Figure 3:
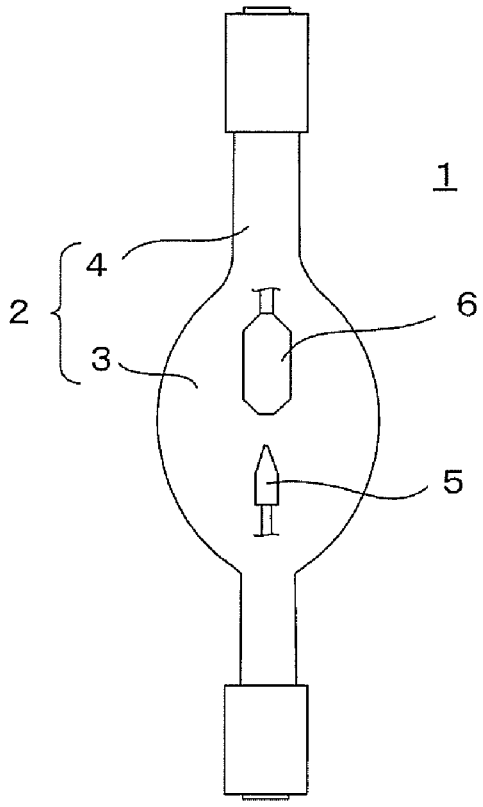
(Prior Art) FIG. 3
FIG. 3 illustrates the construction of a typical short arc discharge lamp.
Figure 4:
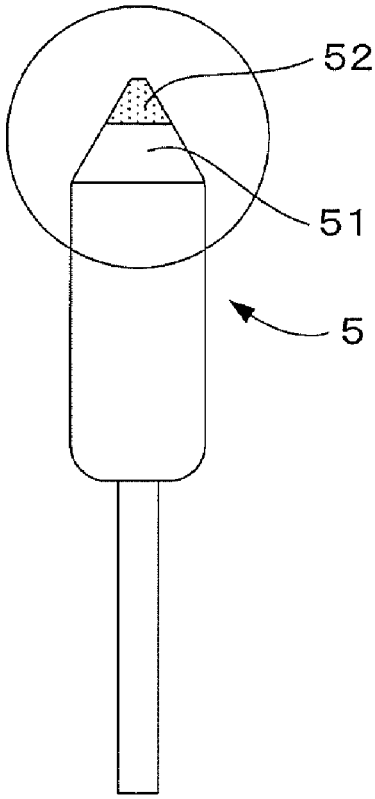
(Prior Art) FIG. 4
FIG. 4 is an enlarged view of a cathode electrode of FIG. 3.
Figure 5A:
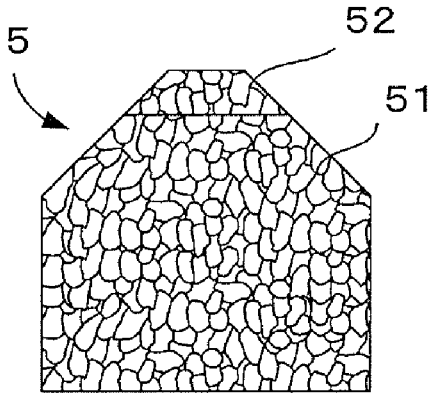
(Prior Art) FIG. 5A
FIG. 5A is sectional view illustrating the structure of the cathode electrode of FIG. 4 at initial lighting stage.
Figure 5B:
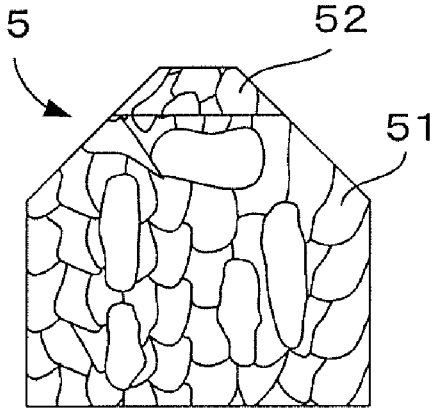
(Prior Art) FIG. 5B
FIG. 5B is sectional view illustrating the structure of the cathode electrode of FIG. 4 after predetermined lighting time.

However, as shown in FIG. 1B and FIG. 2 that is an enlarged view of a front end of the cathode electrode, when the tip part 52 of the cathode electrode that has been doped with thorium oxide is exposed to arc, it is heated to a very high temperature, and grain boundary diffusion of thorium oxide (or thorium) occurs on the tip part 52. Therefore, although the tip part 52 contains thorium oxide, as time passes in the high temperature state, the growth of tungsten grains is induced, and crystal grains coarsen.

With regard to diffusion of thorium oxide (or thorium) along grain boundaries, the coarsening of the crystal grains reduces the distance of a path from the internal portion of the cathode electrode to the tip part. Therefore, this is preferable in terms of the diffusion of thorium oxide (or thorium).

In other words, in terms of the tip part 52 of the cathode electrode, it is not preferable to add a doping material such as potassium, which restrains growth of grains, thereto.

On the other hand, in the body part 51 of the cathode electrode, because the concentration of potassium contained in the body part 51 is higher than that of the tip part 52, growth of crystal grains is restrained, whereby its recrystallization temperature is increased compared to that of tungsten having no doping material. Therefore, tungsten grains are restrained from coarsening.

In other words, crystal grains of tungsten of the body part 51 are controlled to be smaller than the crystal grains of tungsten of the tip part 52. As a result, due to small crystal grains, many grain boundaries are formed to have a multi-branching structure.

In the tip part 52 of the cathode electrode, CO gas is unavoidably generated by reduction of thorium oxide. CO gas is diffused through multibranching grain boundaries towards the body part 51 of the cathode electrode that has low CO concentration. Here, the body part 51 can sufficiently occlude CO gas, because it has a comparatively long diffusion path. Thanks to this, CO can be prevented from being accumulated in the tip part 52 of the cathode electrode, and reduction of thorium oxide is not disrupted. Hence, thorium can be reliably supplied to the tip part over a long time.

As described above, in the cathode electrode according to the present invention, since the concentration of potassium of the body part 51 is higher than the concentration of potassium of the tip part 52, the crystal grains of tungsten of the body part 51 can be restrained from coarsening, and multibranched grain boundaries can be maintained. Therefore, the body part 51 can function as a part to occlude CO gas generated in the tip part 52.

Furthermore, in the tip part 52 of the cathode electrode, because the pressure of CO gas can be restrained from being increased, the reduction of thorium oxide can be continuously conducted without being slowed or stopped, whereby thorium atoms can be reliably provided to the front end of the cathode electrode.

As a result, the present invention can provide a short arc discharge lamp in which supply of thorium as an emitter material is satisfactory and arc can be reliably maintained.

Hereinafter, an example of a method of manufacturing the cathode electrode of the short arc discharge lamp according to the present invention will be described.

A thoriated tungsten rod (W-2% $ThO_2$) for the tip part of the cathode electrode is machined by a lathe, for example, into a diameter of 15 mm and a length of 7 mm. Furthermore, a tungsten rod (99.99% pure tungsten) for the body part of the cathode electrode is machined by the lathe, for example, into a diameter of 15 mm and a length of 38 mm.

The concentration of potassium contained in the thoriated tungsten rod is, for example, 5 wt ppm or less. The concentration of potassium contained in the pure tungsten rod, for instance, ranges from 30 wt ppm to 40 wt ppm.

At least one of junction surfaces of the thoriated tungsten rod for the tip part and the pure tungsten rod for the body part is formed such that the surface roughness thereof, in detail, the center line average height roughness, ranges from 0.05 μm to 1.5 μm. Each junction surface is formed such that the surface planarity thereof ranges from 0.1 μm to 1.5 μm.

Subsequently, the thoriated tungsten rod for the tip part and the pure tungsten rod for the body part are disposed such that the junction surfaces thereof are brought into contact with each other. Thereafter, in a state in which compressive force of 50 MPa is axially applied to the rods under vacuum conditions, the rods are electrically heated such that the temperature of the junction surfaces becomes about 2000° C., and the heated state is maintained for approximately five minutes. Then, the thoriated tungsten rod and the pure tungsten rod are bonded to each other on the interface therebetween by solid-phase diffusion bonding, thus forming an integrated cathode electrode substance.

The cathode electrode material that has passed through the solid-phase bonding process is machined by cutting, thus forming the cathode electrode, in which the diameter of the front end thereof is ϕ1.6 mm, the angle of the front end is 60°, the length of the tip part is 7 mm, the length of the electrode is 45 mm, the front end is an emitter part (thoriated tungsten), and a rear part is the body part (pure tungsten) containing potassium ranging 30 wt ppm to 40 wt ppm.

As described above, the present invention provides a cathode electrode formed by solid-phase bonding a tip part made of thoriated tungsten to a body part made of tungsten. The cathode electrode is configured such that the concentration of potassium of the body part is higher than the concentration of potassium of the tip part. Thus, as the lighting time passes, in the tip part, tungsten crystal grains grow and coarsen, and internal thorium is diffused and is easily moved to the outer surface of the cathode electrode. Furthermore, in the body part, the crystal grains are restrained from coarsening, so that multibranched grain boundaries are formed, whereby CO gas which is generated by reduction of thorium oxide in the tip part can be effectively diffused to the body part without staying in the tip part. Thereby, reduction of thorium oxide in the tip part can be reliably performed for a long time without pausing. As a result, supply of thorium to the surface of the front end of the cathode electrode can be satisfied, whereby the arc can be stabilized.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A short arc discharge lamp, comprising: an arc tube; and a cathode electrode and an anode electrode disposed opposite to each other in the arc tube, the cathode electrode comprising a body part made of tungsten and a tip part made of thoriated tungsten, the body part and the tip part being solid-phase bonded to each other, wherein the cathode electrode is configured such that a potassium concentration of the body part is higher than a potassium concentration of the tip part.

* * * * *